United States Patent [19]

Zuniga

[11] 4,184,399

[45] Jan. 22, 1980

[54] MAGNETIC PICKUP ASSEMBLY

[76] Inventor: Sergio P. Zuniga, P.O. Box 187, Pacific Palisades, Calif. 90272

[21] Appl. No.: 718,385

[22] Filed: Aug. 27, 1976

[51] Int. Cl.[2] ..... G10H 3/08

[52] U.S. Cl. ..... 84/1.15; 84/1.16

[58] Field of Search ..... 84/1.14–1.16; 310/168–170; 336/110, 135

[56] References Cited

U.S. PATENT DOCUMENTS

| | | | |
|---|---|---|---|
| 2,510,094 | 6/1950 | Fleury | 84/1.15 |
| 2,612,541 | 9/1952 | DeArmond | 336/110 |
| 2,909,092 | 10/1959 | Armond et al. | 84/1.15 |
| 3,338,047 | 8/1967 | Kueffer | 58/23 TF |
| 3,715,446 | 2/1973 | Kosinski | 84/1.16 |
| 3,916,751 | 11/1975 | Stich | 84/1.16 |
| 3,992,972 | 11/1976 | Rickard | 84/1.16 |
| 4,040,321 | 8/1977 | Lover | 84/1.15 |

FOREIGN PATENT DOCUMENTS

| | | | |
|---|---|---|---|
| 588178 | 5/1947 | United Kingdom | 84/1.15 |

*Primary Examiner*—Edith S. Jackmon

[57] ABSTRACT

A magnetic pickup assembly for use with a musical instrument having a plurality of strings, each in magnetic relation with at least one polepiece of a magnetic pickup. The assembly includes means for selectively adjusting the reluctance between a polepiece and its associated string, either of a plurality of polepieces as a unit, or of an individual polepiece relative to its string. The assembly is housed in a casing having acoustic absorptive material surrounding the major portions of the assembly, to provide acoustic isolation from the environment including mechanical vibration of the instrument itself.

9 Claims, 11 Drawing Figures

MAGNETIC PICKUP ASSEMBLY

BACKGROUND AND SUMMARY OF THE INVENTION

The present invention relates generally to musical instruments having magnetic pickups for amplification of sound produced by the instrument, and more particularly to an assembly for use with such instruments as pianos and guitars, and permitting the user to make infinitely variable adjustments of components, by which to produce uniquely expressive musical results.

Magnetic pickups for stringed instruments are well known in the art, as exemplified for example by the construction shown in the Lover U.S. Pat. No. 2,896,491, by which the vibrations of one or more tensioned strings are converted into electrical signals carrying musical intelligence which is a function of those vibrations. The electrical signals so produced may then be amplified or modified in any of many ways well known in the art to be eventually applied to a loudspeaker or other electroacoustic transducer.

In accordance with the preferred form of the present invention as disclosed herein, there is provided a magnet and coil assembly which is acoustically insulated by which to minimize and virtually eliminate acoustic absorption of stray acoustic fields, as from a loudspeaker and from vibrations of the body itself of the musical instrument such as a guitar. Furthermore, each of the individual polepieces are so constructed and mounted in the assembly as to permit the user to adjust the effective reluctance of the magnetic path between the polepiece and its associated string, so that the user can thereby achieve uniquely individualized musical results. A further feature of the invention lies in the fact that the magnetic pickup assembly as a unit, including typically six individual polepieces, may be incrementally raised and lowered relative to the strings, whereby again to achieve uniquely individualized musical effects.

The principal object of the present invention is accordingly to provide and disclose a novel magnetic pickup assembly for use with stringed instruments. Additional objects and purposes of the invention are to provide, in such an assembly, conveniently adjustable means for incrementally positioning the assembly as a unit relative to the set of strings of the instrument; to provide and disclose in such an assembly an acoustic absorptive mounting whereby to substantially isolate the polepieces and their associated windings from stray acoustic vibration in the environment, including physical vibration of the instrument itself; to provide and disclose in such an assembly individual polepieces whose magnetic coupling with their associated strings may be infinitely selectively variable by the user, by a simple rotation of a selected polepiece; and for other and additional objects and purposes as will be understood from a reading of the following description of a preferred embodiment of the invention, taken in connection with the accompanying drawings.

DETAILED DESCRIPTION

Figure 1:
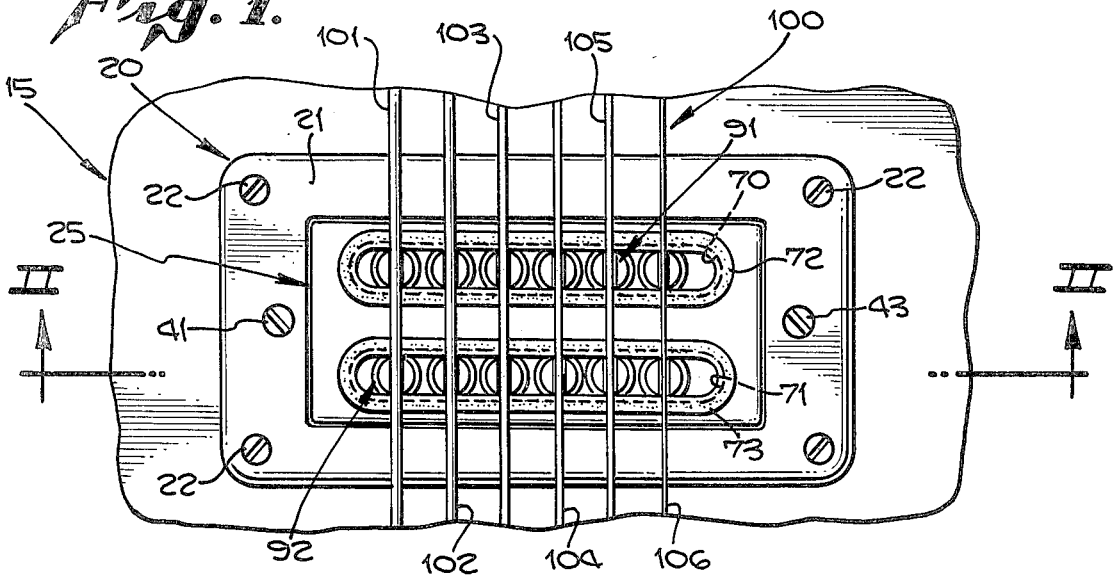
FIG. 1 is a top plan view of a magnetic pickup assembly in accordance with the present invention, together with, fragmentarily shown, a set of six strings, such as those of an electric guitar.
Figure 5:
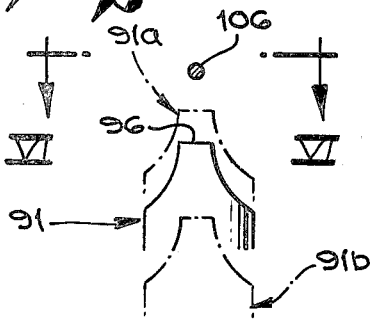
FIG. 5 is a fragmentary sectional view taken on the arrows V—V of FIG. 4, including, diagrammatically shown, selectively varied positions of the polepiece relative to its associated string.
Figure 2:
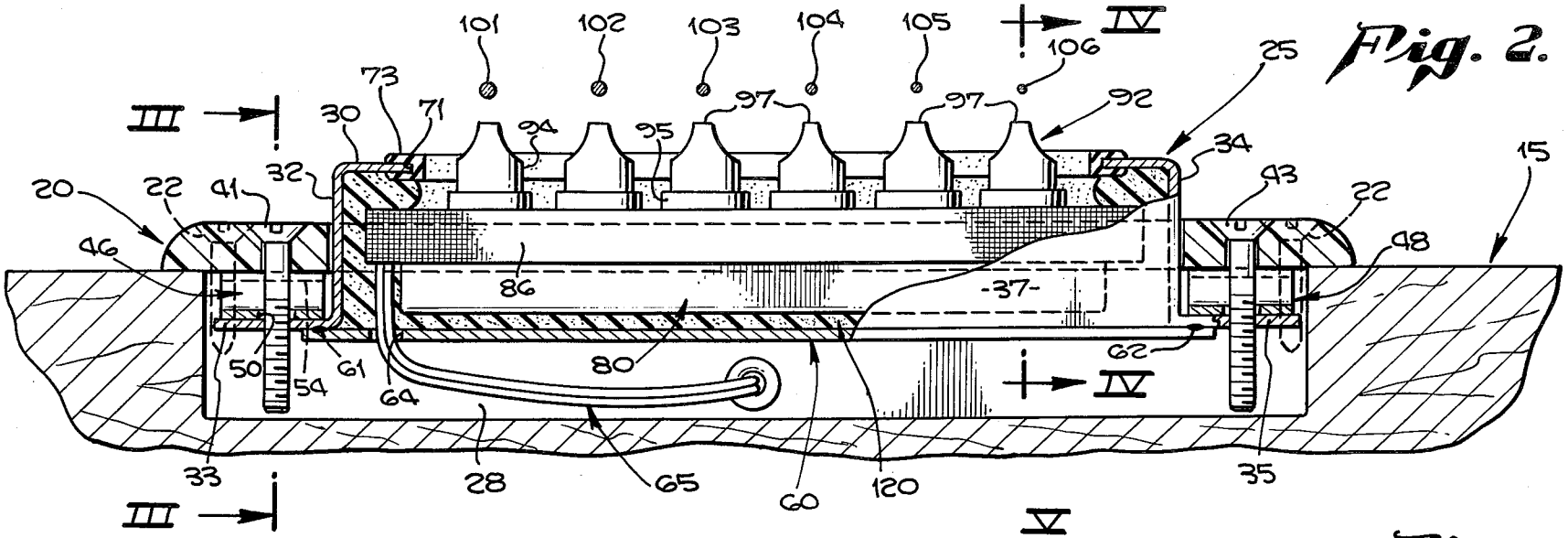
FIG. 2 is a sectional view taken on the arrows II—II of FIG. 1.

Referring now in detail to the drawings, and first to FIG. 1 thereof, there is indicated generally at 15 a portion of the body of a stringed instrument, here exemplarily shown as a guitar. A magnetic pickup assembly in accordance with the present invention is indicated generally at 20 and includes a generally rectangular hollow frame 21 which is attached to body 15 by suitable attachment means such as screws 22. More particularly, the operative magnetic components of the present pickup assembly are housed within a metal casing indicated generally at 25 which, as best shown in FIG. 2, is received in a generally rectangular recess 28 formed in body 15. With continued reference to FIG. 2, casing 25 includes an upper wall 30 and downwardly depending end walls 32 and 34, which terminate downwardly in outwardly turned attachment flanges 33 and 35 respectively. Casing 25 also has, as seen in FIG. 4, downwardly depending sidewalls 36 and 37.

Figure 3:
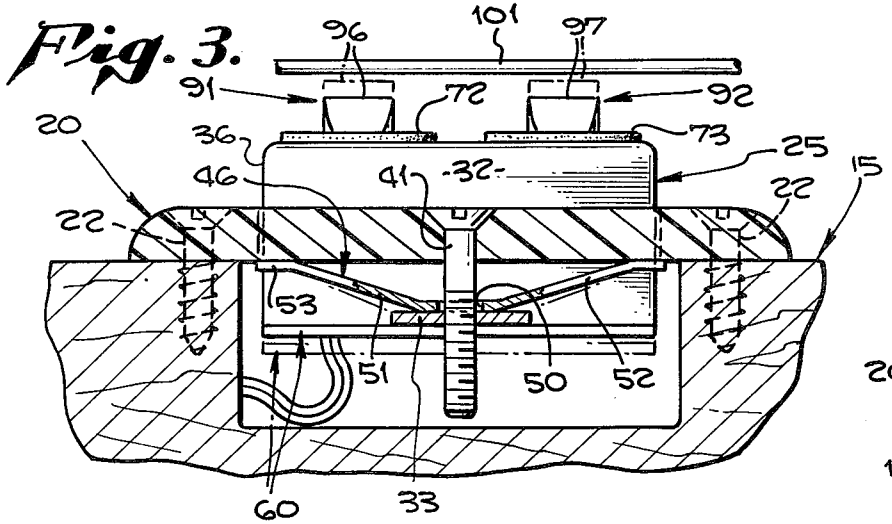
FIG. 3 is a sectional view taken on the arrows III—III of FIG. 2.

Means are provided for selectively adjusting the vertical position of casing 25, as seen in FIG. 2, relative to body 15 and frame 20. Such means in the present form of the invention include a pair of adjustment screws 41 and 43, whose lower threaded portions are received in threaded openings formed in flanges 33 and 35 respectively. Cooperating with screws 41 and 43, and constituting means for urging the casing 25 downwardly relative to frame 20 is a pair of leaf springs, one at each end of the assembly as seen in FIG. 2, and indicated generally therein at 46 and 48. The construction of springs 46 and 48 will be best understood by the showing of FIG. 3, wherein it will be seen that spring 46 has formed in its center an opening 50 through which extends the lower threaded shank of screw 41, and a pair of symmetrically disposed outwardly extending arms 51 and 52 terminating outwardly and upwardly in a pair of flattened feet 53 and 54 respectively, which slidably bear on the lower surface of frame 20. It will be understood that spring 48 at the opposite end of the assembly is similarly formed. It will accordingly be seen that, by rotation of screw 41 or screw 43, the respective end of casing 25 can be raised or lowered relative to frame 20.

The open bottom of casing 25 is closed by a cover plate indicated generally at 60, fixed to the casing as by being brazed or similarly attached at 61 and 62 to the casing flanges 33 and 35, the cover being desirably provided with an opening 64 for receiving therethrough a cable indicated generally at 65 including two or more electrical conductors connected to the magnetic pickups in known manner. The upper wall 30 of casing 25 has formed therein (see FIG. 1) a pair of longitudinally extending parallel slots 70 and 71, and each of the slots is provided with an insulating liner 72 and 73 respectively, made of resilient rubbery material and each provided with an outwardly directed peripheral groove for receiving the edges of slots 70 and 71, as will be particularly seen in FIGS. 2 and 4.

Figure 4:
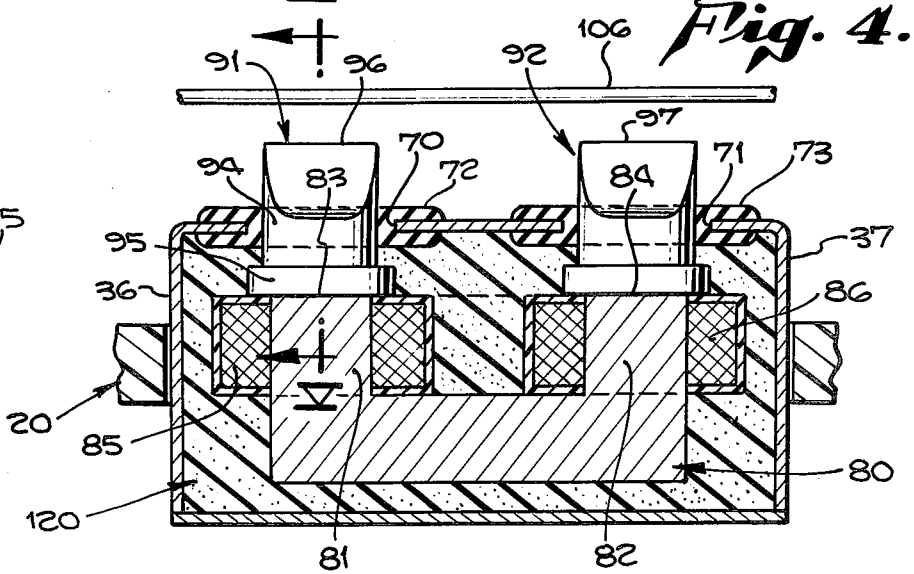
FIG. 4 is a sectional view taken on the arrows IV—IV of FIG. 2.

Within the housing formed by casing 25 and cover plate 60 there is disposed a set of U-shaped magnets each having a winding on each of its two legs, all as best seen in FIG. 4, and as is conventional in the art. Specifically, in FIG. 4 a U-shaped magnet indicated generally at 80 includes a pair of upwardly extending legs 81 and 82, each of the legs terminating upwardly in a flat poleface 83 and 84 respectively. Each leg 81, 82 has mounted thereon an electrical winding 85 and 86 respectively; the details of wiring to the windings are not shown, since they are well known in the art and form no part of the present invention as such.

With continued reference to FIG. 4, a pair of polepieces 91 and 92 are carried above polefaces 83 and 84. Polepiece 91 includes a cylindrical body portion 94 formed integrally with a lower cylindrical flange 95 whose lower surface is in tight magnetic contact with poleface 83. The upper portion of polepiece 91 is narrowed, terminating inwardly in a flat, generally rectangular face 96. The other polepiece 92 seen in FIG. 4 is similarly formed, having an upper generally rectangular face 97. The cylindrical body portion 94 of polepiece 91 is in frictional contact with the opposed inner faces of resilient liner 70, and the corresponding cylindrical body portion of polepiece 92 is similarly in frictional relation with the opposed inner faces of liner 71.

The exemplary form of the present invention contemplates the use of six strings indicated generally at 100, and specifically identified as 101–106 inclusive. As is conventional, the string 106 of highest pitch may have a diameter of approximately 0.25 mm, while the string 101 for the lowest pitch may have a diameter of approximately 1.75 mm. The relationship between strings 100 and the magnetic pickup assembly of the present invention, and the variations of those relationships in accordance with the invention, will be understood by reference to FIGS. 5–10, illustrating certain of those relationships. More particularly, in FIG. 5, the upper portion of polepiece 91 is shown in solid lines in an intermediate position and, in dotted outline, is shown at **91*a* and 91*b* in an upper position and a lower position respectively. As will be understood from the previous description of FIG. 3, the several positions seen in FIG. 5 of polepiece 91 correspond to an adjustment achieved by rotation of screw 41, and the upward pressure of leaf spring 46, urging upwardly the set of pickup units. As brought out in FIG. 6, the longer axis of upper rectangular face 96 remains parallel to string 106** during these adjustments.

Figure 7:
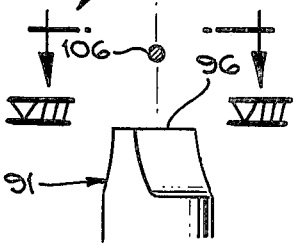
FIG. 7 is a view similar to FIG. 5, except showing the polepiece rotated approximately 45° about its axis from its position of FIG. 5.
Figure 8:
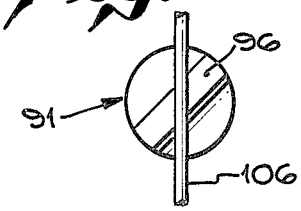
FIG. 8 is a view looking downwardly on the arrows VIII—VIII of FIG. 7.
Figure 10:
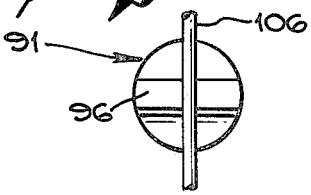
FIG. 10 is a view similar to FIGS. 6 and 8, except showing the polepiece rotated 90° about its axis from its position of FIGS. 5 and 6.

In FIGS. 7 and 8 there is shown polepiece 91 in its position relative to string 106 when the polepiece is rotated approximately 45° about its own axis. It will be recalled in this connection that the cylindrical portion of each polepiece is in frictional contact with resilient liner 70 or 71, as the case may be, whereby that frictional relationship will maintain the polepiece in whatever angular position the user may choose to rotate it. In FIG. 10 is shown the relationship of the string and polepiece when the user has rotated the polepiece about its own axis through 90° from its position seen in FIG. 6.

Figure 9:
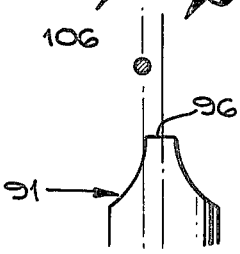
FIG. 9 is a fragmentary view similar to FIG. 5, except showing the polepiece moved slightly laterally so that its axis is displaced from the axis of its associated string.
Figure 6:
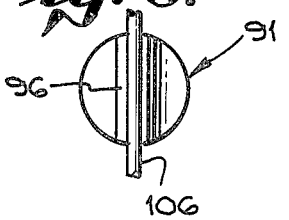
FIG. 6 is a view looking downwardly on the arrows VI—VI of FIG. 5.

An additional capability of variation of the relationship between the polepiece and its associated string in accordance with the invention is illustrated in FIG. 9. In that showing, polepiece 91 is displaced laterally from its associated string 106, by digital adjustment by the user, to produce unique tonal modulations, as may be desired by the user.

Figure 11:
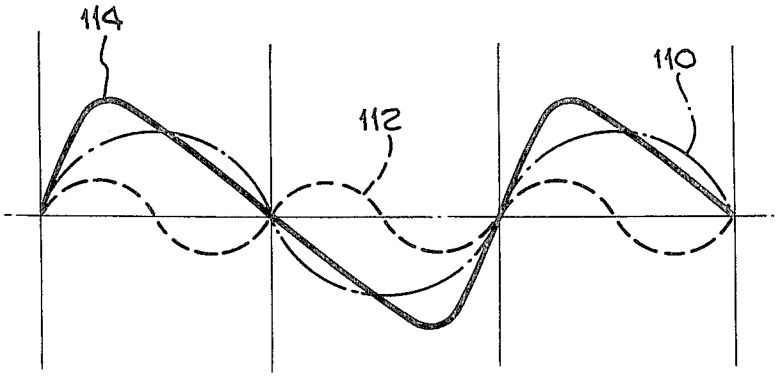
FIG. 11 is a set of waveforms clarifying certain aspects of the invention.

In FIG. 11 there is shown a waveform 110 of the fundamental tone produced by a particular string. Indicated at 112 is a waveform corresponding to the first harmonic of such a tone, and indicated at 114 is a composite or summing waveform of waveforms 110 and 112. In the relationship of the parts seen in FIG. 9, it will be seen that, because of the lateral displacement of the polepiece from its associated string, the components of the fundamental tone produced by the string and the first harmonic (as well as other harmonics) produced by the same string will be altered in their instantaneous relationship with the polepiece. More specifically, the instantaneous reluctance of the magnetic path will be different from such reluctance when the parts are in their typical or neutral position seen in FIG. 5, as indicated at 91.

Means are provided for acoustically isolating the magnetic pickups of the present invention from the environment, and in the present illustrative form of the invention such means are shown as including spongy material indicated generally at 120, within the enclosure provided by casing 25 and its lower cover plate 60, and surrounding the magnet 80 and its coils 85 and 86, as well as surrounding the lower portions of the polepieces whose bases are in tight magnetic contact with the polefaces 83 and 84 of the magnet. Thus environmental acoustic vibration, as from loudspeakers or the like, as well as mechanical vibration of the guitar or other instrument itself, is effectively shielded from reaching the magnetically sensitive portions of the assembly.

It will accordingly be seen that there is here provided a magnetic pickup assembly including constructions by which the user can incrementally vary the magnetic reluctance, either of the assembly as a whole by adjustment of screws 41, 43, or individually for each polepiece, by rotating it angularly as previously described in connection with FIGS. 5–8; and further variability of the reluctance of the magnetic path between a polepiece and its associated string is afforded by the lateral displaceability of the polepiece relative to the string illustrated in FIG. 9. By these selectively adjustable variations, the individual musician can achieve unique tonal effects not heretofore available.

Although a particular preferred embodiment of the invention has herein been described and illustrated in detail, it will be understood that modifications and changes from such embodiment may be made, and all such modifications and inventions not departing from the spirit of the invention are intended to be embraced within the scope of the appended claims.

I claim:

1. In a musical instrument having a plurality of vibratable strings each in magnetic relation with at least one polepiece of a magnetic pickup, the provision of a magnetic pickup assembly comprising:

a plurality of magnetic pickups, one for each string, wherein the magnetic circuit for each pickup includes a polepiece with a surface at one end in magnetic relation with a string, the polepiece surface having an elongated rectangular shape, the polepiece being rotatable to vary the angle formed between the string and the elongated shape of the polepiece surface to provide variation of the tonal quality of the transduced sound from the string; and adjusting means for varying the distance between all pickups and all strings simultaneously.

2. The invention as defined in claim 1 wherein the polepiece has a second end with a flat surface in close magnetic relation with a flat surface of a magnetic poleface.

3. The invention as defined in claim 2 including means in frictional contact with the polepiece for retaining it in its selected rotated position.

4. In a musical instrument having a plurality of vibratable strings each in magnetic relation with at least one polepiece of a magnetic pickup, the provision of a magnetic pickup assembly comprising:

a plurality of magnetic pickups, one for each string, including means for selectively varying the reluctance between a polepiece and its associated string, and wherein the magnetic circuit of each pickup includes a magnet having a poleface and a polepiece having a lower base portion in close magnetic relation with the poleface but selectively movable relative thereto a generally rectangular casing for housing the pickups, a pair of leaf springs, one at each end of the casing and extending transversely thereof, for biasing the respective casing end away from the strings, and a selectively adjustable threaded member at each end of the casing for drawing the respective casing end toward the strings, each leaf spring comprising a flat central part having a hole surrounding one of the threaded members, the flat part bearing downward on a mating flat part of the casing and two ends each bearing upward against a structural part of the instrument, to form a balanced stabilizer to prevent canting of the casing relative to the strings.

5. The invention as defined in claim 4 wherein said polepiece has an end surface facing a string in magnetic relation therewith, the endsurface being elongated forming a polepiece substantially rectangular in shape, having a length greater than its width.

6. The invention as defined in claim 5 wherein said polepiece has a second end with a flat surface in close magnetic relation with a flat surface on the poleface.

7. The invention as defined in claim 6 wherein said polepiece is selectively rotatable about an axis perpendicular to the flat surface on the poleface.

8. The invention as defined in claim 7 including means in frictional contact with the polepiece for retaining the polepiece in its selected rotated position.

9. The invention as defined in claim 8 wherein the end surface of the polepiece facing the string has a minor dimension of the same order of magnitude as the diameter of the string and a major dimension a least an order to magnitude greater than the minor dimension.

* * * * *